US005217321A

United States Patent [19]

Corcoran et al.

[11] Patent Number: 5,217,321

[45] Date of Patent: Jun. 8, 1993

[54] COMPACTOR TOOTH

[75] Inventors: Paul T. Corcoran, Washington; George B. Kokos, Mapleton; David O. Philips, Metamora, all of Ill.

[73] Assignee: Caterpiller Inc., Peoria, Ill.

[21] Appl. No.: 812,533

[22] Filed: Dec. 23, 1991

[51] Int. Cl.[5] ..... E01C 19/26

[52] U.S. Cl. ..... 404/121; 172/554; 404/124

[58] Field of Search ..... 404/121, 124; 301/41 R, 301/43, 44 R; 172/540, 554, 713, 719

[56] References Cited

U.S. PATENT DOCUMENTS

| | | | |
|---|---|---|---|
| H946 | 8/1991 | Lonn | 404/121 |
| 3,274,908 | 9/1966 | Grant et al. | 94/48 |
| 3,297,096 | 1/1967 | Woolridge | 172/464 |
| 3,318,211 | 5/1967 | Grace | 404/124 |
| 3,891,341 | 6/1975 | Trainor et al. | 404/121 |
| 4,074,942 | 2/1978 | Cochran | 404/121 |
| 4,919,566 | 4/1990 | Caron et al. | 404/121 |

*Primary Examiner*—William P. Neuder

*Attorney, Agent, or Firm*—J. W. Burrows

[57] ABSTRACT

Capactor teeth are normally utilized to provide crushing and/or grinding and compaction of refuse material and to compact soil on top of the refuse material. It is advantageous to provide a tooth that provides good traction of a capactor wheel and both good demolition and penetration of the material being crushed. In the subject arrangement, a tooth has an outer surface which has at least six edges with a plurality of side surfaces extending therefrom and angled with respect thereto at an obtuse angle. The tooth has a generally rectangular base with a longitudinal plane defined therein parallel to the length of the generally rectangular base. Apexes defined by the side surfaces are parallel with the longitudinal plane and angled with respect to the outer surface within the range of 115°-135°. The shape of the outer surface along with the plurality of side surfaces extending therefrom at an obtuse angle with respect to the outer surface provides a tooth that readily penetrates and compacts the refuse material and/or soil while providing good traction of the compactor wheel with respect to the materials being compacted.

20 Claims, 5 Drawing Sheets

COMPACTOR TOOTH

DESCRIPTION

1. Technical Field

This invention relates generally to a tooth for use on a compactor wheel and more particularly to the profile of the tooth.

2. Background Art

Compacting wheels are frequently used in landfill operations to grind and/or crush and compact refuse materials to reduce the bulk size of the refuse materials followed by covering the refuse materials with a layer of soil. Various types of arrangements are used to provide both compaction of the material and also traction of the compactor wheel on the materials. One such example is illustrated in U.S. Pat. No. 4,074,942 which issued Feb. 21, 1978, to T. E. Cochran. This arrangement provides a tooth having an outer tip portion with a "plus" configuration and is operable to provide both the grinding and/or crushing and compaction of the materials while also providing traction of the wheel on the materials. Another typical arrangement is illustrated in U.S. Pat. No. 4,919,566 which issued Apr. 24, 1990, to J. O. Caron et al. In this arrangement a plurality of traction teeth are secured to the compactor wheel and a separate set of demolition teeth are also secured to the wheel. Each of the above arrangements provide both grinding and/or crushing and compaction of the materials while also providing traction of the wheel on the materials. In many instances, however, the above noted arrangements may disturb the surface of the refuse material and/or soil due to the entry and exit of the tooth during operation which may lead to erosion of the refuse material material and/or soil by wind and/or rain. Likewise, in some of the above noted arrangements, refuse materials and/or soil may become clogged between the teeth.

It is desirable to provide a tooth profile that provides high penetration and compaction of the material being worked while also providing good traction of the wheel on the material. It is also desirable to provide less refuse material and/or soil surface disturbance during the compaction process.

The present invention is directed to overcoming one or more of the problems as set forth above.

DISCLOSURE OF THE INVENTION

In one aspect of the present invention, a tooth is provided and adapted for use on a compactor wheel. The tooth includes a body portion and a tip portion. The body portion has a generally rectangular base and defines a longitudinal plane parallel to the length of the base. The tip portion has an outer surface that is spaced outwardly from the generally rectangular base and includes at least six edges connected one to the other forming obtuse angles therebetween. The at least six edges has a pair of opposed edges and a plurality of other edges. Each edge of the pair of opposed edges being spaced from the other a predetermined distance and parallel with the longitudinal axis. A plurality of side surfaces extend from each edge of the at least six edges towards the generally rectangular base. The plurality of side surfaces that extend from the plurality of other edges of the at least six edges extend at an obtuse angle with respect to the outer surface of the tip.

The present invention provides a simple tooth having a profile with good compaction, high penetration, and good traction while reducing the disturbance of the refuse material and/or soil surface during the compaction process.

BEST MODE FOR CARRYING OUT THE INVENTION

Figure 1:
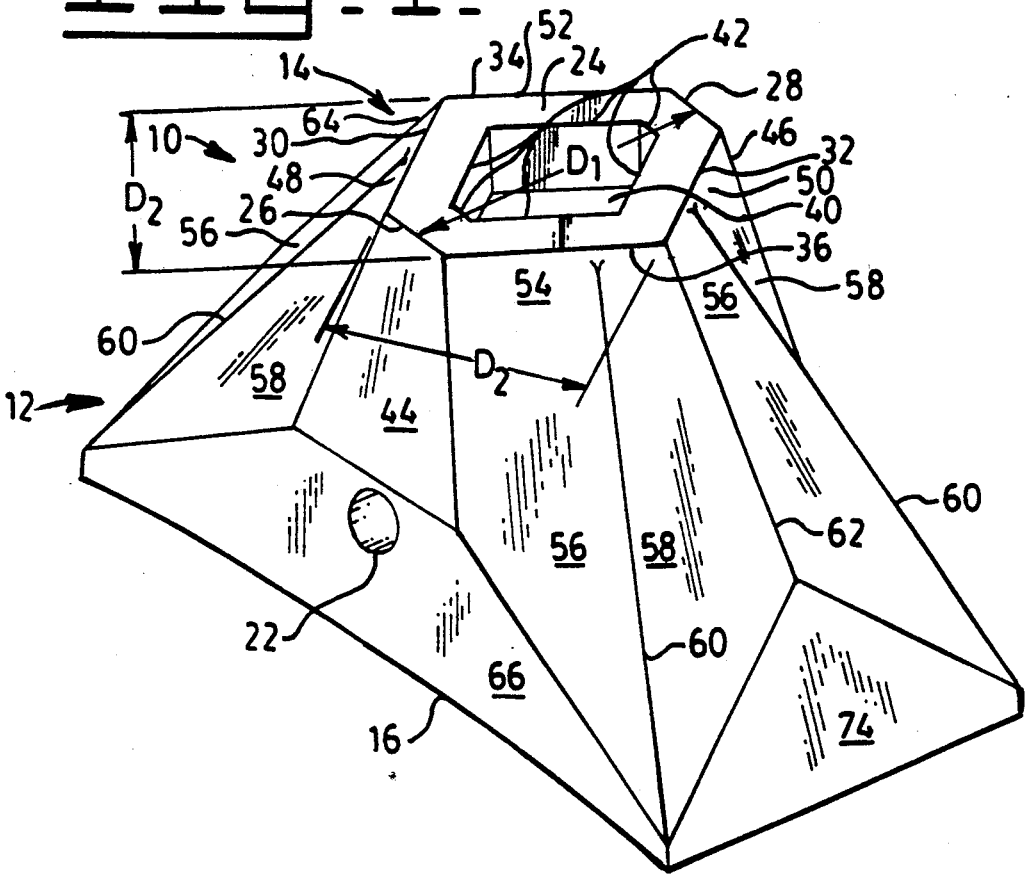
FIG. 1 is an isometric drawing representing the profile of an embodiment of the present invention.
Figure 2:
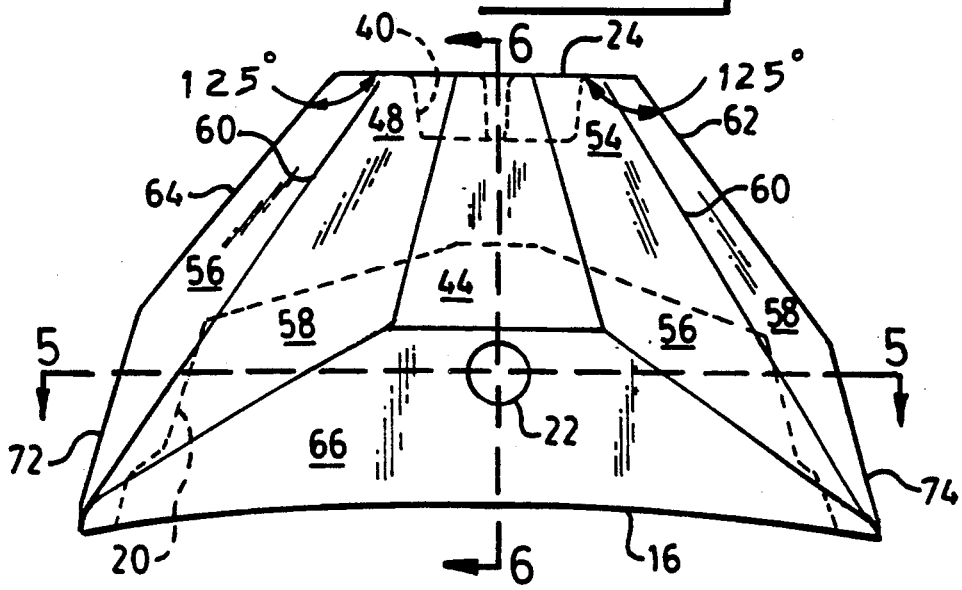
FIG. 2 is a side view of the tooth illustrated in FIG. 1.
Figure 3:
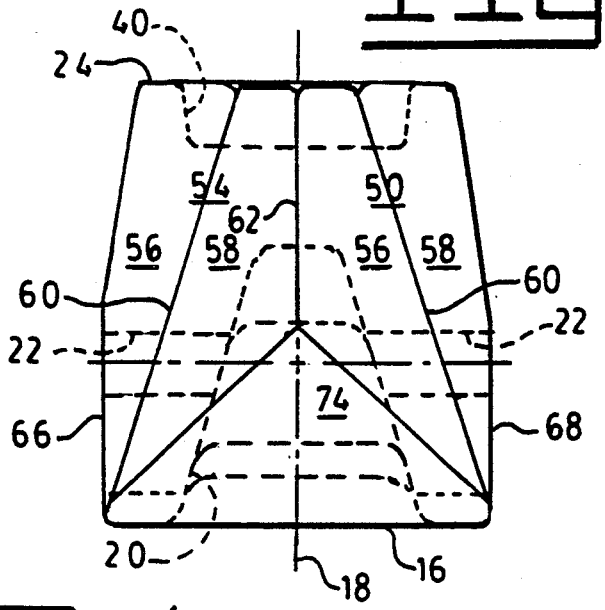
FIG. 3 is an end view of the tooth illustrated in FIG. 1.
Figure 4:
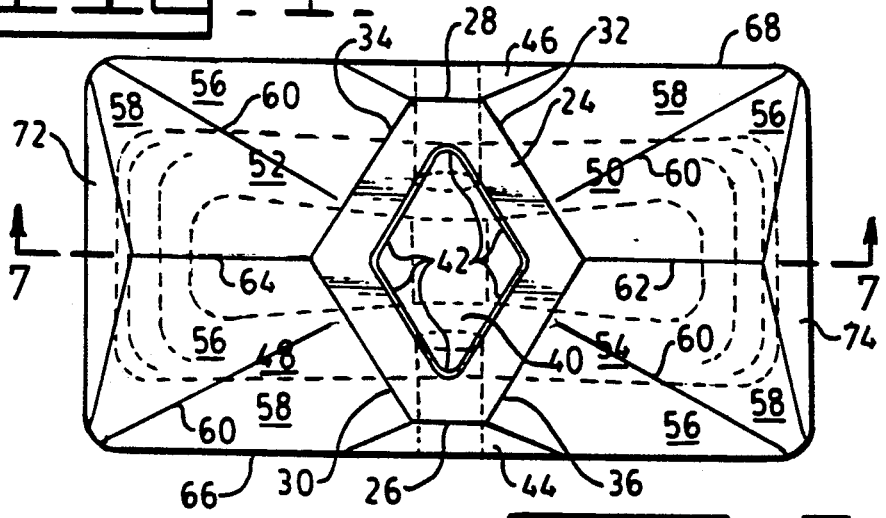
FIG. 4 is a top view of the tooth illustrated in FIG. 1.
Figure 5:
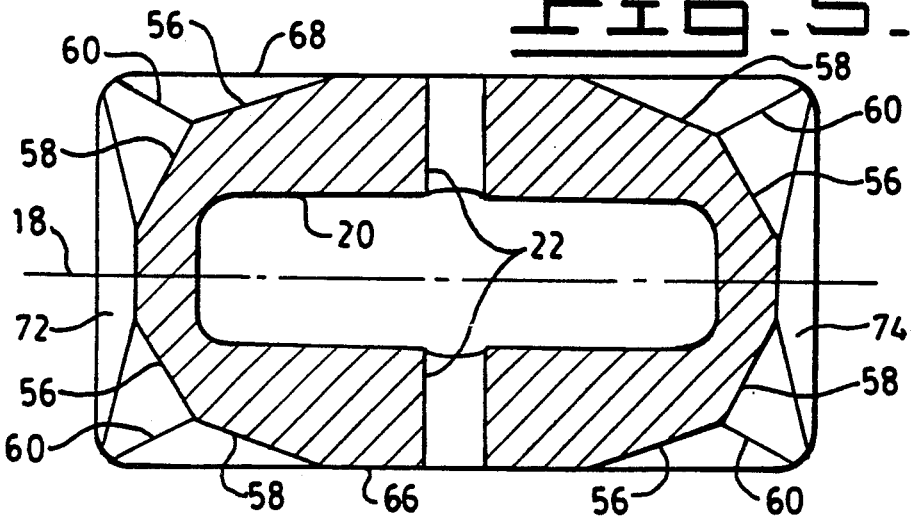
FIG. 5 is a cross sectional view taken along the lines 5—5 of FIG. 2.
Figure 6:
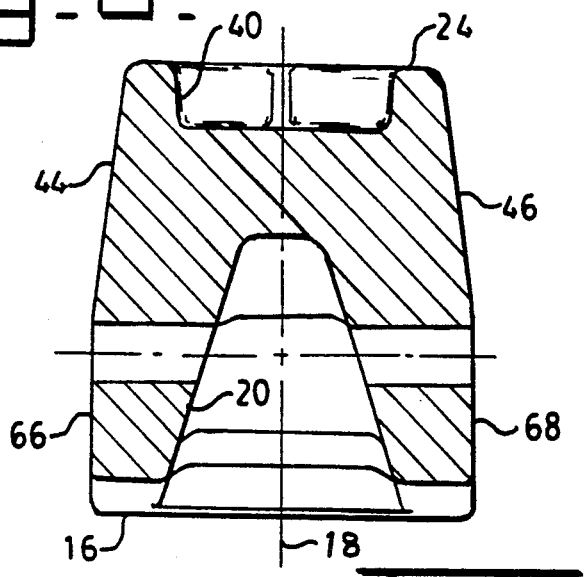
FIG. 6 is a cross sectional view taken along the lines 6—6 of FIG. 2.
Figure 7:
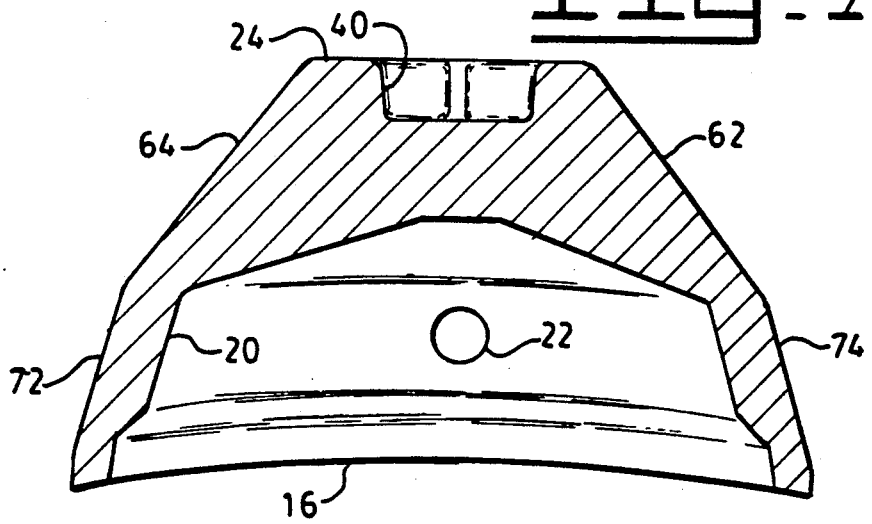
FIG. 7 is a cross sectional view taken along the lines 7—7 of FIG. 4.

Referring to FIGS. 1–7 of the drawings, a tooth 10 is illustrated and adapted for use on a compactor wheel (not shown) of a conpacting machine. The tooth 10 includes a body portion 12 and a tip portion 14.

The body portion 12 has a generally rectangular base 16. A longitudinal plane 18 extends through the tooth 10 parallel to the length of the tooth and parallel to the direction of travel of the compactor wheel (not shown). The longitudinal plane 18 is generally perpendicular to the generally rectangular base 16. A cavity 20 is defined in the body portion 12 and extends inwardly from the generally rectangular base 16. The cavity 20 is adapted in use to mate With an adapter that is secured to the wheel of the compactor in order for the tooth 10 to be releasably retained on the compactor wheel. It is recognized that the tooth 10 could be welded to the compactor wheel as opposed to being pinned to an adapter without departing from the essence of the invention.

A pair of aligned holes 22 are defined in the body portion 12 of the tooth 10 perpendicular to the longitudinal plane 18 and each hole of the pair of holes 22 is located on opposite sides of the cavity 20. The tip portion 14 is spaced outwardly from the generally rectangular base 16 and includes an outer surface 24. The outer surface 24, as illustrated, has a slight curvature but is normally considered as being generally flat. The outer surface 24 of FIGS. 1–7 has six edges 26, 28, 30, 32, 34, 36, each being connected one to the other to form obtuse angles therebetween. The six edges includes a first pair of opposed edges 26, 28 and a plurality of other edges 30, 32, 34, 36. Each edge of the first pair of edges 26, 28 is spaced from the other a predetermined distance $D_1$ and oriented parallel with the longitudinal plane 18. The at least six edges of the outer surface 24 includes a second pair of opposed edges 30, 32, spaced from each other a second smaller predetermined distance $D_2$ and a third pair of opposed edges 34, 36 spaced from each other a predetermined distance that is the same as the second smaller predetermined distance $D_2$. A recess 40 is defined in the tip portion 14 and extends inwardly from the outer surface 24. The recess 40 is centrally disposed in the outer surface 24 and has a plurality of additional edges 42 located on the outer surface 24 adjacent the recess 40. Each respective edge of the plurality of additional edges 42 is parallel to a respective edge of the six edges 26, 28, 30, 32, 34, 36 of the outer surface 24 and spaced equal distances therefrom.

A plurality of side surfaces 44, 46, 48, 50, 52, 54 extend from the corresponding edges of the six edges 26, 28, 30, 32, 34, 36 of the outer surface 24 of the tip portion 14 towards the generally rectangular base 16. Each side surface 44, 46, 48, 50, 52, 54 extends from the outer surface 24 towards the generally rectangular base 16 at an obtuse angle with respect to the outer surface 24. The plurality of side surfaces 48, 50, 52, 54, which extend from the plurality of other edges 30, 32, 34, 36 of the outer surface 24 originate as a plane surface and evolve into two plane surfaces 56, 58, respectively. The side surfaces 48, 50, 52, 54 form an angle with the direction of travel that is less than 90 degrees. An apex 60 formed by the respective plane surfaces 56, 58 extends towards the respective corners of the generally rectangular base 16. A leading apex 62 is formed by the two side surfaces 50, 54 and a trailing apex 64 is formed by the two side surfaces 48, 52. The leading and trailing apexes 62, 64 are parallel with the longitudinal plane 18 and extend towards the generally rectangular base 16 at an angle in the range of 115°-135° with respect to the outer surface 24. The angle of the leading and trailing apexes 62, 64 is more preferably in the range of 120°-130° with respect to the outer surface 24. The leading and trailing apexes 62, 64 and the respective side surfaces 48, 52 and 50, 54 constitute portions of the tooth 10 facing toward and away from the direction of travel of the compactor wheel.

Additional side surfaces 66, 68 extend outwardly from the generally rectangular base 16 parallel to the longitudinal plane 18 and perpendicular to the outer surface 24. The additional side surfaces 66, 68 intersect the side surfaces 44, 46 which extend from the first pair of opposed edges 26, 28 at a location such that the pair of aligned holes 22 separated by the cavity 20 extends between the additional side surfaces 66, 68. The additional side surfaces 66, 68 as illustrated and described are perpendicular to the outer surface 24. However, it is recognized that the additional side surfaces 66, 68, as well as the other surfaces, could have draft angles defined thereon for manufacturing purposes without departing from the essence of the invention. Draft angles are normally in the range of 5 to 7 degrees in both directions from the parting line of the forging dies or the casting molds.

Yet additional side surfaces 72, 74 extend from the generally rectangular base 16 outwardly and are oriented perpendicular to the longitudinal plane 18 and form an obtuse angle with the outer surface 24 that is smaller than the first obtuse angle formed by the leading and trailing apexes 62, 64 and the outer surface 24. The yet additional side surfaces 72, 74 extend towards the outer surface 24 and intersect respective ones of the side surfaces 48, 50, 52, 54 extending from the plurality of other edges 30, 32, 34, 36.

Figure 8:
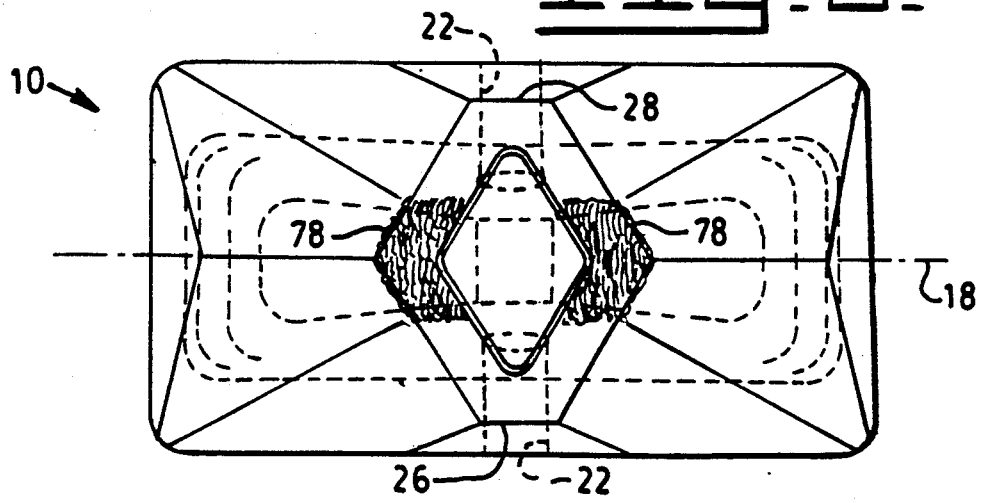
FIG. 8 is a top view of a modified embodiment of the tooth illustrated in FIG. 1.

Referring now to FIG. 8, another embodiment of the present invention is disclosed. The tooth 10 illustrated in FIG. 8 is generally identical to the tooth 10 illustrated and described with respect to FIGS. 1-7 with the following exception. A hard particle material 78 is bonded to the outer surface 24 of the tip portion 14. The hard particle material 78 is centrally disposed between the first pair of opposed edges 26, 28 and oriented parallel to the longitudinal plane 18. It is recognized that the hard particle material 78 could be applied to the outer surface 24 by a welding process or that the hard particle material could be bonded to the outer surface 24 by providing a recess for an insert to be brazed thereto without departing from the essence of the invention. Furthermore, the hard particle material could be cast into the outer surface. For best results, the hard particle material 78 covers the longitudinal length of the outer surface 24 and up to approximately one-third to one-half of the predetermined distance $D_1$ between the first pair of opposed edges 26, 28.

Figure 9:
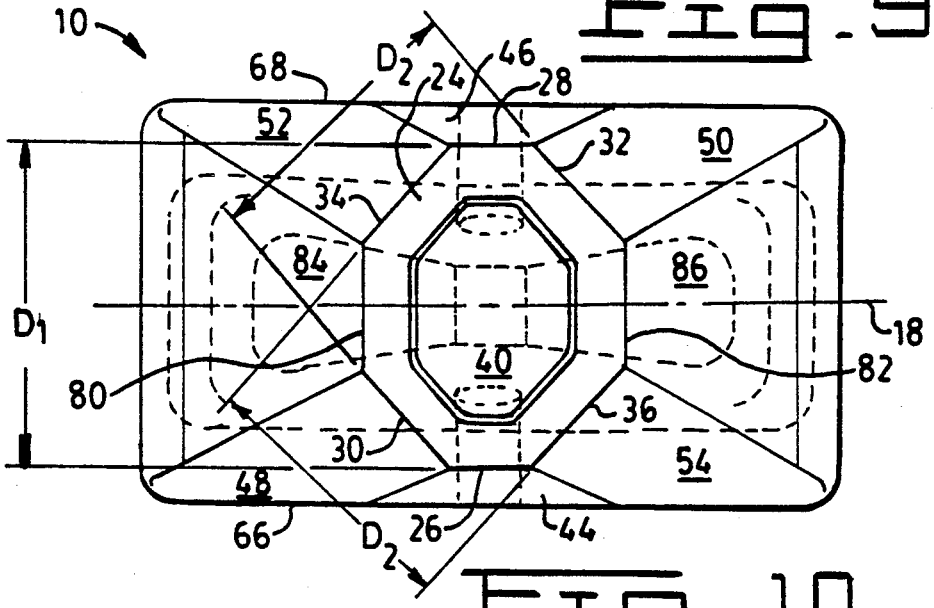
FIG. 9 is a top view of another embodiment of the present invention.
Figure 10:
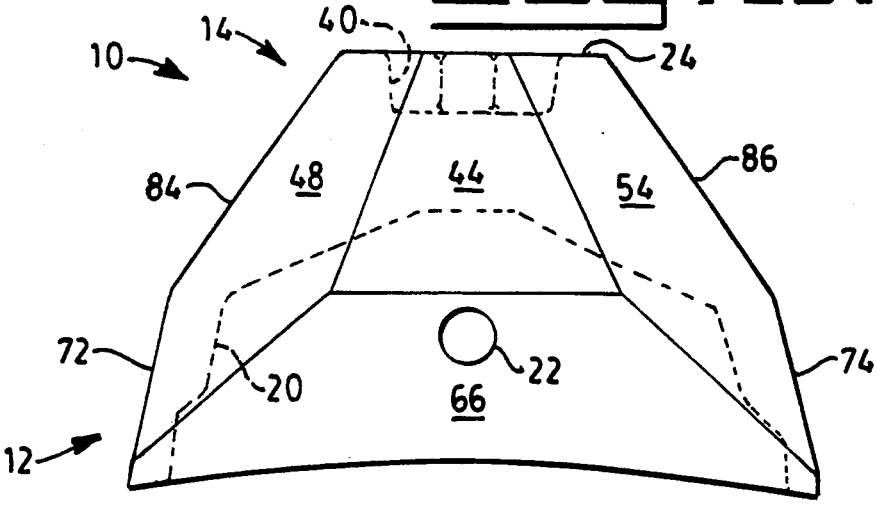
FIG. 10 is a side view of the embodiment of FIG. 9.
Figure 11:
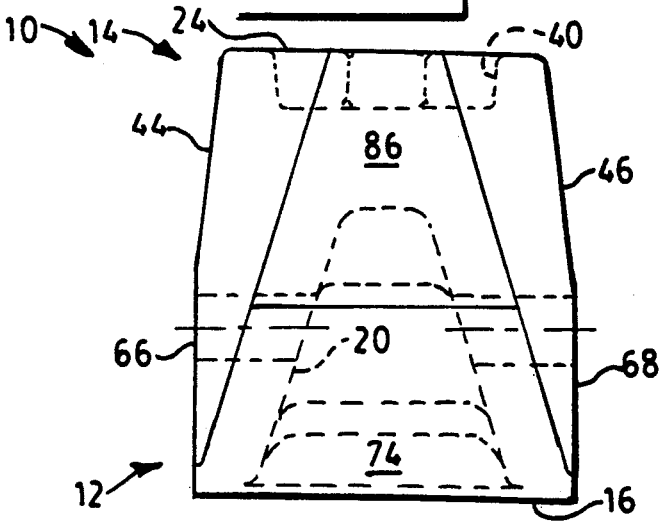
FIG. 11 is an end view of the embodiment of FIG. 9.

Referring now to FIGS. 9, 10, and 11, another embodiment of the tooth 10 is illustrated. The tooth 10 of FIGS. 9-11 is similar in many aspects to the tooth 10 of FIGS. 1-7. Consequently, like elements in FIGS. 9-11 will retain the corresponding number from the elements of FIGS. 1-7. The major distinction between the tooth 10 of FIGS. 9-11 as compared to the tooth 10 of FIGS. 1-7 is that the tip portion 14 of FIGS. 9-11 has eight edges and eight side surfaces extending therefrom as compared to the six edges and six side surfaces set forth in FIGS. 1-7. New element numbers will be affixed only to the added edges and added side surfaces. The outer surface 24 of FIGS. 9-11 includes the edges 26, 28, 30, 32, 34, 36 plus edges 80, 82. Likewise, side surfaces 44, 46, 48, 50, 52, 54 plus side surfaces 84, 86 extend from the respective edges 26, 28, 30, 32, 34, 36, 80, 82 of the outer surfaces 24. In the subject arrangement, the added side surfaces 84, 86 are oriented perpendicular to the longitudinal plane 18 and form an obtuse angle with respect to the outer surface 24 in the range of 115°-135° and more preferably in the range of 120°-130°. The angle illustrated is 125°. The side surfaces 84, 86 of the subject embodiment constitute portions of the tooth 10 facing toward and away from the direction of travel of the compactor wheel.

The plurality of side surfaces 48, 50, 52, 54 which extend from the plurality of other edges 30, 32, 34, 36 lie in a single plane as opposed to evolving into two planes as illustrated and described with respect to FIGS. 1-7. The recess 40 of FIGS. 9-11 is substantially the same as the recess 40 in FIGS. 1-7 except in FIGS. 9-11 eight edges are formed adjacent the recess and, like in FIGS. 1-7, each of the eight edges are parallel to the corresponding eight edges of the outer surface 24 and are spaced equal distances therefrom.

As noted with respect to FIGS. 1-7, the additional side surfaces 66, 68 extending from the generally rectangular base 16 and all of the other surfaces could have draft angles provided for manufacturing purposes without departing from the essence of the invention. All other aspects of the additional embodiment set forth in FIGS. 9-11 are the same as that set forth with respect to FIGS. 1-7.

Figure 12:
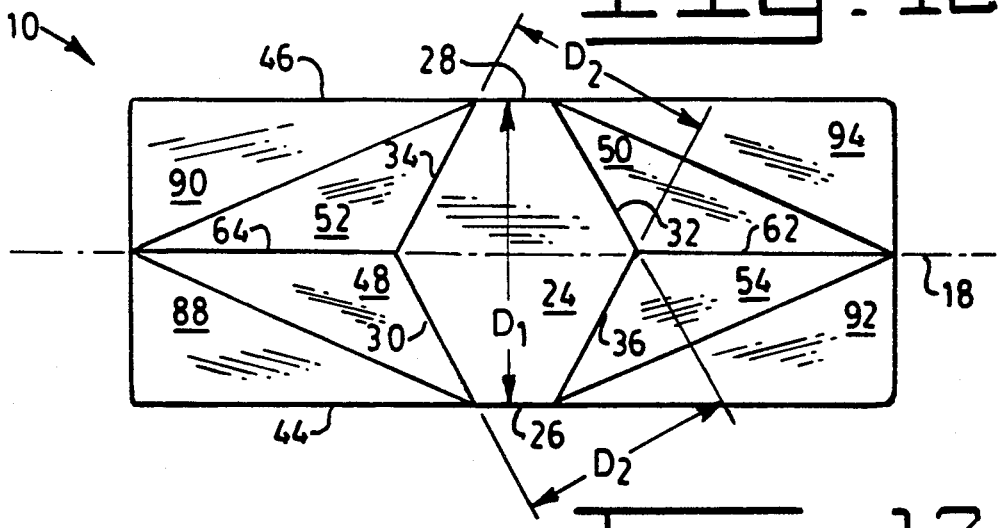
FIG. 12 is a top view of yet another embodiment of the present invention.
Figure 13:
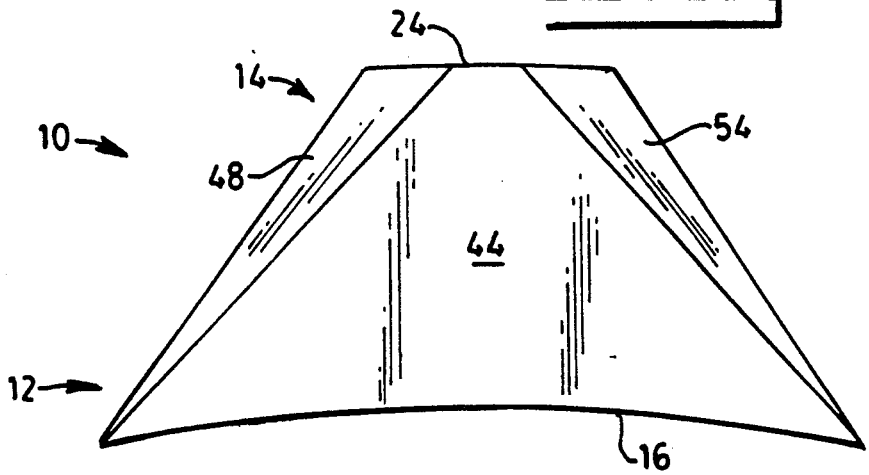
FIG. 13 is a side view of the embodiment illustrated in FIG. 12.
Figure 14:
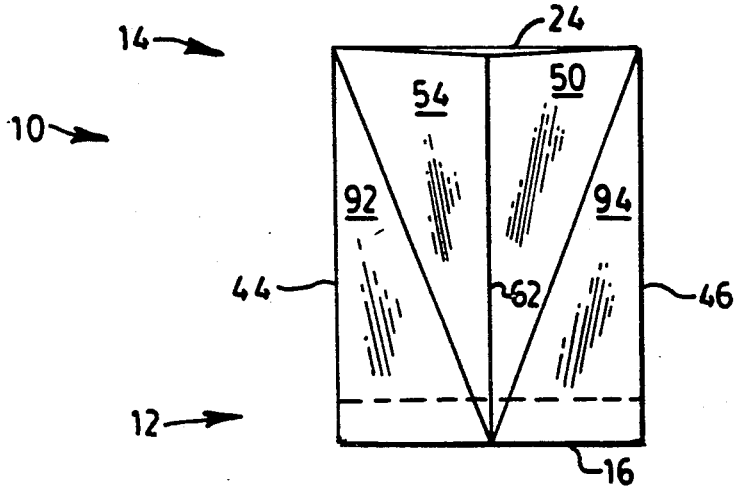
FIG. 14 is an end view of the embodiment illustrated in FIG. 12.

Referring now to FIGS. 12, 13, and 14, another embodiment of the tooth 10 is illustrated. Like or similar elements in FIGS. 12-14 have the same element numbers that correspond to those in FIGS. 1-7. The outer surface 24 of the tip portion 14 includes the six edges 26,

28, 30, 32, 34, 36. Likewise, the first pair of opposed edges 26, 28 are spaced from each other the preselected distance $D_1$. The plurality of other edges 30, 32, 34, 36 has second and third pairs of opposed edges 30, 32, 34, 36 spaced from each other the second smaller predetermined distance $D_2$. In the arrangement set forth in FIGS. 12–14, the first predetermined distance $D_1$ is equal to the width of the generally rectangular base 16. Consequently, the side surfaces 44, 46 extending from the first pair of opposed edges 26, 28 are perpendicular to the outer surface 24 and extend downwardly to the generally rectangular base 16.

The plurality of side surfaces 48, 50, 52, 54 extending from the plurality of other edges 30, 32, 34, 36 of the outer surface 24 extend downwardly to form an obtuse angle with respect to the outer surface 24. Two of the side surfaces 48, 52 form the leading apex 62 and the other two side surfaces 50, 54 form the trailing apex 64. The leading and trailing apexes 62, 64 extends from the outer surface 24 to a mid-point of the width of the generally rectangular base 16. Likewise, the respective pairs of sides surfaces 48, 52 and 50, 54 extend to the respective mid-points of the width of the generally rectangular base 16.

A plurality of flat surfaces 88, 90, 92, 94 are located on the body portion 12 and oriented in one aspect perpendicular to the longitudinal plane 18. The respective flat surfaces 88, 90, 92, 94 originate generally at the respective ends of the first pair of opposed edges 26, 28 of the outer surface 24 and terminate along a portion of the width of the generally rectangular base 16 between the corners thereof and a mid-point therebetween.

The tooth 10 illustrated in FIGS. 12–14 is adapted to be welded to the wheel of the compactor but it is readily recognized that a cavity could be provided so that the tooth 10 could be removably attached to the wheel of the compactor. Furthermore, it is recognized that a recess could be defined in the outer surface 24 as set forth in FIGS. 1–11. Likewise, the recess 40 in FIGS. 1–11 could be eliminated without departing from the essence of the invention. Also, the distances $D_1$ and $D_2$ could be equal in length.

INDUSTRIAL APPLICABILITY

In use, the tooth 10 provides good crushing and/or grinding of the refuse material and/or soil while still providing high compaction of the refuse materials and/or soil being compacted and good traction of the drive wheel with respect to the materials being compacted. Furthermore, any tendency for refuse material and/or soil to pack between the plurality of teeth on the compactor wheel is substantially eliminated. The ability of the tooth 10 to inhibit the collection of refuse material and/or soil from packing between the plurality of teeth is enhanced by the plurality of side surfaces 44, 46, 48, 50, 52, 54 extending from the respective edges of the plurality of edges 26, 28, 30, 32, 34, 36 of the outer surface 24 at an obtuse angle.

The elimination of soil disturbance during use is attributed, in FIGS. 1–8 and 12–14, to the angle of the apex 62 and 64 being at an angle with respect to the outer surface 24 in the range of 115°–130°. The angle formed by the apexes 62 and 64 is more preferably in the range of 120°–130°. In FIGS. 9–11, the elimination of soil surface disturbance during use is attributed to the angle of the side surfaces 84, 86 being within the above noted range of angles. The noted range of angles permits the tip portion 14 of the tooth 10 to enter and exit the refuse material and/or soil without lifting or kicking up the refuse material and/or soil as the tip portion 14 exits the materials being compacted.

Greater compaction of the soil in all directions is likewise attributed to the plurality of surfaces 48, 50, 52, 54 extending from the plurality of other edges 30, 32, 34, 36 being angled at an obtuse angle with respect to the outer surface 24 and at an angle of less than 90 degrees with respect to the direction of travel. The purpose of this angle is to force a pressure distribution in the refuse material and/or the soil during tractive effort of the compactor wheel that is wider than the width of the tooth 10. Furthermore, in FIGS. 1–11, the sides surfaces 44, 46 extending at an obtuse angle from the first pair of opposed edges 26, 28 further enhances refuse material and/or soil compaction in a transverse direction to the longitudinal plane 18 of the tooth 10. The shape of the tip portion 14 permits it to readily engage the soil and/or refuse material to be compacted and readily penetrate the materials to achieve the compaction while also providing good traction of the compacting machine.

There is a direct relationship that exists in a tooth 10 in order to achieve compaction, traction, and penetration. If the tooth 10 cannot penetrate, the traction of the tooth 10 is greatly inhibited. Likewise, if the tooth penetrates too easily, the refuse material and/or the soil will not be fully compacted by the tip portion 14 of the tooth 10. The above noted and described embodiments provide a tooth 10 that can readily penetrate and compact the refuse material and/or the soil while providing adequate traction. The recess 40 provides traction benefits both when the tooth 10 is new and as it wears. The reduced area of contact, provided by the recess 40, between the outer surface 24 and the material surface provides penetration of the tip portion 14 on hard and/or frozen material. In softer materials the recess 40 fills with material and thus acts as a generally larger area to provide the necessary compaction forces. This is beneficial, for example, when the tooth 10 is being worked on frozen refuse material and/or soil. Furthermore, the depth of the recess 40 could be utilized as a wear gauge to indicate that once the material around the recess 40 has been worn away the tooth 10 should be replaced.

The hard particle material that is bonded to the outer surface 24 of the tip portion 14 enhances the ability of the tooth 10 to penetrate the soil and/or refuse material being compacted as the tooth 10 is being worn during use. This is attributed to the fact that the resistance to wear along a portion of the outer surface 24 is controlled by the hard particle material 78 thus maintaining better sharpness of the tooth 10. Even though the tooth 10 has been described for use in land fill operations, it should be recognized that the tooth 10 would be likewise effective as a soil compaction tooth.

In view of the foregoing, it is readily apparent that the profile of the tooth 10 provides an arrangement that allows the tooth 10 to readily penetrate and compact the refuse material and/or soil while providing good traction of the tooth 10 relative to the surface being compacted.

Other aspects, objects, and advantages of this invention can be obtained from a study of the drawings, the disclosure, and the appended claims.

We claim:

1. A tooth adapted for use on a compactor wheel, comprising:

a body portion having a generally rectangular base and defining a longitudinal plane parallel to the length of the generally rectangular base, and a tip portion having an outer surface with at least six edges connected one to the other forming obtuse angles therebetween and being spaced outwardly from the generally rectangular base, the at least six edges having a pair of opposed edges and a plurality of other edges each edge of the pair of edges being spaced from the other a predetermined distance and parallel with the longitudinal plane, a side surface extends from each edge of the at least six edges towards the generally rectangular base with the side surfaces that extend from the plurality of other edges of the at least six edges extending at an obtuse angle with respect to the outer surface of the tip portion.

2. The tooth of claim 1 wherein the angle of portions of the tooth facing toward and away from the direction of travel of the compactor wheel is in the range of 115° to 135° with respect to the outer surface of the tip portion.

3. The tooth of claim 2 wherein the angle of the portions of the tooth facing toward and away from the direction of travel of the compactor wheel is preferably in the range of 120° to 130° with respect to the outer surface of the tip portion.

4. The tooth of claim 3 wherein the plurality of other edges has second and third pairs of opposed edges each edge of the respective second and third pairs of edges being spaced from the other at a second predetermined distance.

5. The tooth of claim 4 wherein the second predetermined distance is less than the first predetermined distance.

6. The tooth of claim 5 wherein a cavity is defined in the body portion and extends inwardly from the generally rectangular base.

7. The tooth of claim 6 wherein a pair of aligned holes are defined in the body portion perpendicular to the longitudinal plane and each hole of the pair of aligned holes is located on opposite sides of the cavity.

8. The tooth of claim 7 wherein the outer surface of the tip portion has only six edges.

9. The tooth of claim 6 wherein a recess is defined in the tip portion and extends inwardly from the outer surface thereof.

10. The tooth of claim 9 wherein the shape of the recess is generally the same shape as that defined by the at least six edges of the outer surface of the tip portion.

11. The tooth of claim 10 wherein the recess is centrally disposed in the outer surface of the tip portion.

12. The tooth of claim 11 wherein the recess forms a plurality of additional edges on the outer surface that are parallel to the corresponding at least six edges of the outer surface.

13. The tooth of claim 12 wherein the predetermined distance between the first pair of opposed edges is less than the width of the generally rectangular base.

14. The tooth of claim 13 wherein the side surfaces extending from the first pair of opposed edges towards the generally rectangular base extend at an obtuse angle relative to the outer surface of the tip portion.

15. The tooth of claim 14 wherein each side surface of the side surfaces extending at an angle from each of the plurality of other edges of the at least six edges originates as a plane surface and evolves into two plane surfaces having an apex thereof which extends towards the respective corners of the generally rectangular base.

16. The tooth of claim 15 wherein additional side surfaces extend from the generally rectangular base parallel to the longitudinal plane and oriented generally perpendicular to the outer surface of the tip portion.

17. The tooth of claim 16 wherein yet additional side surfaces extend from the generally rectangular base perpendicular to the longitudinal plane and oriented at a second smaller obtuse angle with respect to the outer surface of the tip portion.

18. The tooth of claim 17 wherein a cavity is defined in the body portion and extends inwardly from the generally rectangular base.

19. The tooth of claim 18 wherein a pair of aligned openings are defined in the body portion separated by the cavity, perpendicular to the longitudinal plane, and extend between the additional side surfaces.

20. The tooth of claim 19 wherein a hard particle material is bonded on the tip portion and is centrally disposed between the first pair of opposed edges and parallel to the longitudinal plane.

* * * * *